US006686550B2

(12) United States Patent
Seki et al.

(10) Patent No.: US 6,686,550 B2
(45) Date of Patent: Feb. 3, 2004

(54) SWITCH

(75) Inventors: Hiroshi Seki, Tokyo (JP); Hideji Onodera, Tokyo (JP)

(73) Assignee: Niles Parts Co., Ltd. (JP)

( * ) Notice: Subject to any disclaimer, the term of this patent is extended or adjusted under 35 U.S.C. 154(b) by 0 days.

(21) Appl. No.: 10/216,401

(22) Filed: Aug. 12, 2002

(65) Prior Publication Data

US 2003/0042124 A1 Mar. 6, 2003

(30) Foreign Application Priority Data

Aug. 30, 2001 (JP) ..... P2001-262312

(51) Int. Cl.[7] ..... H01H 21/00
(52) U.S. Cl. ..... 200/553; 200/310
(58) Field of Search ..... 200/308, 310, 200/313, 315, 339, 5 R, 553, 267

(56) References Cited

U.S. PATENT DOCUMENTS 2,808,482 A * 10/1957 Zanichkowsky et al. ..... 200/67
3,032,620 A * 5/1962 Siiberg ..... 200/67
3,598,943 A * 8/1971 Barrett et al.
3,772,484 A * 11/1973 Roeser ..... 200/4
3,872,269 A * 3/1975 Schneider
3,988,556 A * 10/1976 Hyodo ..... 200/511
4,843,200 A * 6/1989 Parlatore et al. ..... 200/553
4,978,823 A * 12/1990 Sato et al.
5,158,172 A * 10/1992 Roeser et al. ..... 200/553
5,293,507 A * 3/1994 Hayakawa
5,336,861 A * 8/1994 Cummins et al.
5,468,926 A * 11/1995 Sato ..... 200/558
5,714,732 A * 2/1998 Lee ..... 200/6 R
5,735,392 A * 4/1998 Shirasaka
6,211,474 B1 * 4/2001 Takahashi ..... 200/18
6,323,450 B1 * 11/2001 Chen ..... 200/553
6,339,201 B1 * 1/2002 Balaban et al. ..... 200/339
6,454,488 B1 * 9/2002 Lewis et al. ..... 404/6
6,459,060 B1 * 10/2002 Bartok ..... 200/553

FOREIGN PATENT DOCUMENTS

JP 63-145232 A1 9/1988
JP 3-20844 A1 2/1991

* cited by examiner

*Primary Examiner*—Michael Friedhofer
*Assistant Examiner*—Lisa Klaus
(74) *Attorney, Agent, or Firm*—Rader, Fishman & Grauer PLLC

(57) ABSTRACT

A switch which can widen a degree of freedom of setting height and shape of a click groove while providing a click groove on a side of a movable contact and promote operation feeling without increasing cost. This switch brings a movable contact into contact with a fixed contact and separates the movable contact therefrom by pivoting a movable piece by moving a steel ball on the movable piece by operating a switch knob; wherein the movable piece is provided with a flat click portion having a contact portion and a click groove at an end edge thereof, the click portion being arranged erect relative to a housing; a steel ball contained in a ball support portion via a coil spring; and an opening of the ball support portion provided with a fitting groove to be fitted loosely to the end edge of the click portion of the movable piece.

7 Claims, 12 Drawing Sheets

SWITCH

BACKGROUND OF THE INVENTION

1. Field of the Invention

The present invention relates to a switch such as a seesaw type switch, a lever switch or the like used in a power window switch or the like of an automobile.

2. Description of the Related Art

There is a conventional seesaw type switch as shown by FIG. 12 and FIG. 13 described in, for example, Japanese Utility Model Laid-Open No.20844/1991. FIG. 12 is a disassembled perspective view and FIG. 13 is a sectional view.

As shown by FIG. 12 and FIG. 13, a conventional seesaw type switch 201 is provided with fixed terminals 205 and 207 and a common fixed terminal 209 at a terminal board 203. A movable contact piece 211 is pivotably supported by the common fixed terminal 209. Movable contacts 213 and 215 are provided at both ends of the movable contact piece 211. The movable contact piece 211 is formed by a plate member and is arranged such that a plate face thereof is directed upwardly. A pin 217 is brought into elastic contact with an upper face of the movable contact piece 211. The pin 217 is contained in a sliding member 219 via a coil spring 221.

Therefore, when the sliding member 219 is moved to a state of FIG. 13 by operating the switch knob, the movable contact 213 on one side is brought into contact with the fixed contact 205 on one side and the fixed contact 205 on one side and the common fixed contact 209 are conducted to each other. Further, when the sliding member 219 is moved to the right side of FIG. 13 by operating the switch knob, the pin 217 is moved to the right side of the common fixed contact 209 by smoothly sliding on the upper face of the movable contact piece 211 by the elastic contact. By moving the pin 217, the movable contact piece 211 is rotated in the clockwise direction in FIG. 13 and the movable contact 215 on other side is brought into contact with the fixed contact 207 on other side. Thereby, the fixed contact 207 on other side and the common fixed contact 209 are conducted to each other.

In this way, by operating the movable contact piece 211 in seesaw movement by operating the switch knob, the movable contacts 213 and 215 can be brought into contact with and separated from the fixed contacts 205 and 207.

Meanwhile, according to the power window switch of an automobile, a click feeling is given to operation of the switch knob in order to give an operator differentiation among lifted and lowered positions and a neutral position of switch operation as the operation feeling.

However, according to the above-described structure, excellent click feeling cannot be given by a side of the movable contact piece 211 and therefore, there must be provided separately a portion having a click groove, a steel ball which is brought into elastic contact with the click groove and a coil spring for urging the steel ball between the switch knob and a switch case. Therefore, there are needed the steel ball and the coil spring other than the pin 217 and the coil spring 221, a number of parts is large, assembling and parts control is complicated to thereby cause an increase in cost.

Further, conventionally, according to a click member of a seesaw type switch, there is used the pin 217 which is long in an up and down direction such that the pin 217 is not detached from the sliding member 219 even when the pin 217 is slided on the movable contact piece 211. The pin 217 is used when an amount of sliding the pin 217 on the movable contact piece 211 is large and a steel ball cannot be used since the steel ball is detached from the sliding member 219. A front end of the pin 217 is constituted by a spherical shape and therefore, it is difficult to fabricate the pin 217 by a large amount when the pin 217 is made of a metal and therefore, a pin molded by resin is generally used. However, there poses a problem that the pin 217 made of resin is devoid of durability and expensive in comparison with the steel ball.

With regard thereto, the present assignee has already proposed a structure as described in Japanese Utility Model Laid-Open No.145232/1988. According to the structure, a movable contact piece is bent by pressing to thereby form a click ridge and a steel ball supported by a slider is brought into contact with the movable contact piece by urge force of a coil spring. Further, a click feeling can be given to a switch knob by cooperatively moving the slider by operating a switch knob and making the steel ball ride over the click ridge.

However, there poses a problem that in forming the click ridge by pressing the movable contact piece, it is difficult to accurately form the click ridge by springback of the movable contact piece in pressing and the degree of freedom of setting a height and a shape of the click ridge is narrow. Further, due to sliding between the movable contact piece made of a metal and the steel ball made of a metal, abrasion powder is produced and a contact failure is caused and in order to achieve smooth sliding, it is necessary to significantly improve an accuracy of finishing a surface of the movable contact piece to thereby cause an increase in cost.

Further, a movable contact board on which the steel ball slides, must be formed such that the ridge portion is lowered and the valley portion is shallowed to prevent the steel ball from being detached from a holder and a change in operational force (click feeling) is reduced when the knob is pivoted. Therefore, according to the seesaw type switch using the steel ball, there poses a problem in which operation feeling is poor and erroneous operation is liable to be brought about since the position is changed from an OFF position to ON position by small operational force.

SUMMARY OF THE INVENTION

It is an object of the invention to provide a switch such as a seesaw type switch, a lever switch or the like capable of widening the degree of freedom of setting a height and shape of a click groove while providing the click groove on the side of a movable contact and capable of promoting an operation feeling without increasing cost thereof.

According to a first aspect of the invention, the invention is concerned switch comprising a fixed contact fixedly supported by a housing, a movable piece pivotably supported by the housing and having a movable contact brought into contact with and separated from a fixed contact, and a switch knob pivotably supported by the housing for operating to move an elastic contact member brought into elastic contact with the movable piece, wherein the movable contact is brought into contact with and separated from the fixed contact by pivoting the movable piece by moving the elastic contact member on the movable piece by operating to pivot the switch knob, and wherein the movable piece is provided with a contact portion made of a conductive material and a click portion made of a resin having a click groove.

According to a second aspect of the invention, in the switch according to the first aspect, the click portion of the movable piece is formed to be flat and comprise the click groove at an end edge thereof and the click portion of the movable piece is arranged to erect relative to the housing such that the elastic contact member is brought into elastic contact with the click groove, wherein the elastic contact member is formed by a steel ball, further comprising a ball support portion in a cylindrical shape for containing the steel ball via an urging member and having an opening at an end portion thereof wherein the opening of the ball support portion is provided with an engaging groove loosely fitted to the end edge of the click portion of the movable piece.

According to a third aspect of the invention, in the switch according to the first or second aspect, a section of the click groove is formed in a recessed shape in accordance with an outer face in a spherical shape of the steel ball.

According to a fourth aspect of the invention, in the switch according to any one of the first to third aspects, the switch further comprises a containing wall portion provided at the housing for surrounding the fixed contact, a slider supporting the elastic contact member and moved by operating to pivot the switch knob, and a slider cover attached to the containing wall portion attachably and detachably, forming a containing space for containing the slider and the movable piece between the slider cover and the containing wall portion and covering the slider movably.

According to the invention of the first aspect, the elastic member which is brought into elastic contact with the movable piece can be operated to move by the switch knob pivotably supported by the housing. The movable piece is pivotably supported by the housing and when the elastic contact member is moved on the movable piece, the movable piece is pivoted and the movable piece can be brought into contact with and separated from the fixed contact fixedly supported by the housing.

Further, the movable pieces provided with the contact portion made of the conductive material and the click portion made of the resin having the click groove and therefore, the click groove can easily be formed at the click portion on the side of the movable contact. Further, the click groove is provided at the click portion made the resin and therefore, a degree of freedom of setting height and shape of the click groove can significantly be widened. The click groove is provided at the click portion made of the resin and therefore, contact of the elastic contact member can smoothly be carried out without providing special surface finish and promotion of operation feeling of the switch knob can be achieved without increasing cost.

According to the invention of the second aspect, in addition to the effect of the invention of the first aspect, the click portion of the movable piece is formed to be flat and is provided with the click groove at the end edge and the click portion of the movable piece is arranged to erect relative to the housing such that the elastic contact member is brought into elastic contact with the click groove, the elastic member is formed by the steel ball, there is further provided the ball support portion in the cylindrical shape for containing the steel ball via the urging member and having the opening at the end portion, the opening portion of the ball support portion is provided with the fitting groove for loosely fitting to the end edge of the click portion of the movable piece and therefore, opening of the ball support portion can be closed by the end edge of the movable piece. Therefore, when the steel ball is moved on the movable piece, the steel ball can be restrained from being detached from the ball support portion and fall of the movable piece can be restrained. In this way, pivoting movement of the movable piece can firmly be carried out, contact and detachment of the movable contact to and from the fixed contact can further firmly be carried out and space can be saved by narrowing a lateral width of the click groove and downsizing of the switch can be achieved.

Further, the flat click portion of the movable piece is arranged to erect relative to the housing and therefore, the degree of freedom of setting height of the click groove can firmly be widened.

Further, since the steel ball is formed by a spherical shape, friction coefficient is small, the steel ball is inexpensive, hard and excellent in durability in comparison with a click pin made of a resin, easy to fabricate and inexpensive owing to a standard product also in comparison with a click pin made of a metal. The click portion of the movable piece to which the fitting groove of the ball support portion is fitted, is made of resin, the smooth face can be formed without finishing the surface, movement between the ball support portion and the movable piece can be made smooth, abrasion powder is prevented from being brought about since metals are not brought into contact with each other, durability of the movable piece having the click groove can be promoted and operation feeling of the switch knob can be promoted.

According to the invention of the third aspect, in addition to the invention of the first or second aspect, the section of the click groove is formed in the recessed shape in accordance with the outer face in the spherical shape of the steel ball and therefore, the steel ball can firmly be held in the click groove by guiding the steel ball in a direction of a center line of the recessed shape by the curved face of the recessed shape and even when external force is applied to the steel ball, detachment of the steel ball can be prevented, the steel ball can always be moved in the recessed shape and therefore, the movable piece is supported by pushing the movable piece to the side of the housing by the steel ball to thereby prevent detachment, sliding movement of the click groove relative to the steel ball can be carried out further smoothly, and operation feeling of the switch knob can be promoted by reducing friction resistance.

According to the invention of the fourth aspect, in addition to the effect of the invention according to any one of the first to third aspects, there are further provided the containing wall portion provided at the housing for surrounding the fixed contact, the slider supporting the elastic contact member and moved by operating to pivot the switch knob, and the slider cover attached to the containing wall portion attachably and detachably, forming the containing space for containing the slider and the movable piece between the slider cover and the containing wall portion and covering the slider movably and therefore, invasion of dust and dirt into the containing space is restrained by the containing wall portion and the slider cover, operation of the movable piece can firmly be carried out and contact and detachment of the fixed contact and the movable contact can be carried out further firmly. The fixed contact, the movable contact, the slider, the slider cover and the containing wall portion constitute a small-sized switch, the fixed contact and the containing wall portion are formed in the housing and therefore, a number of parts and a number of integrating steps can be reduced and cost can be reduced.

DESCRIPTION OF THE PREFERRED EMBODIMENTS

Figure 1:
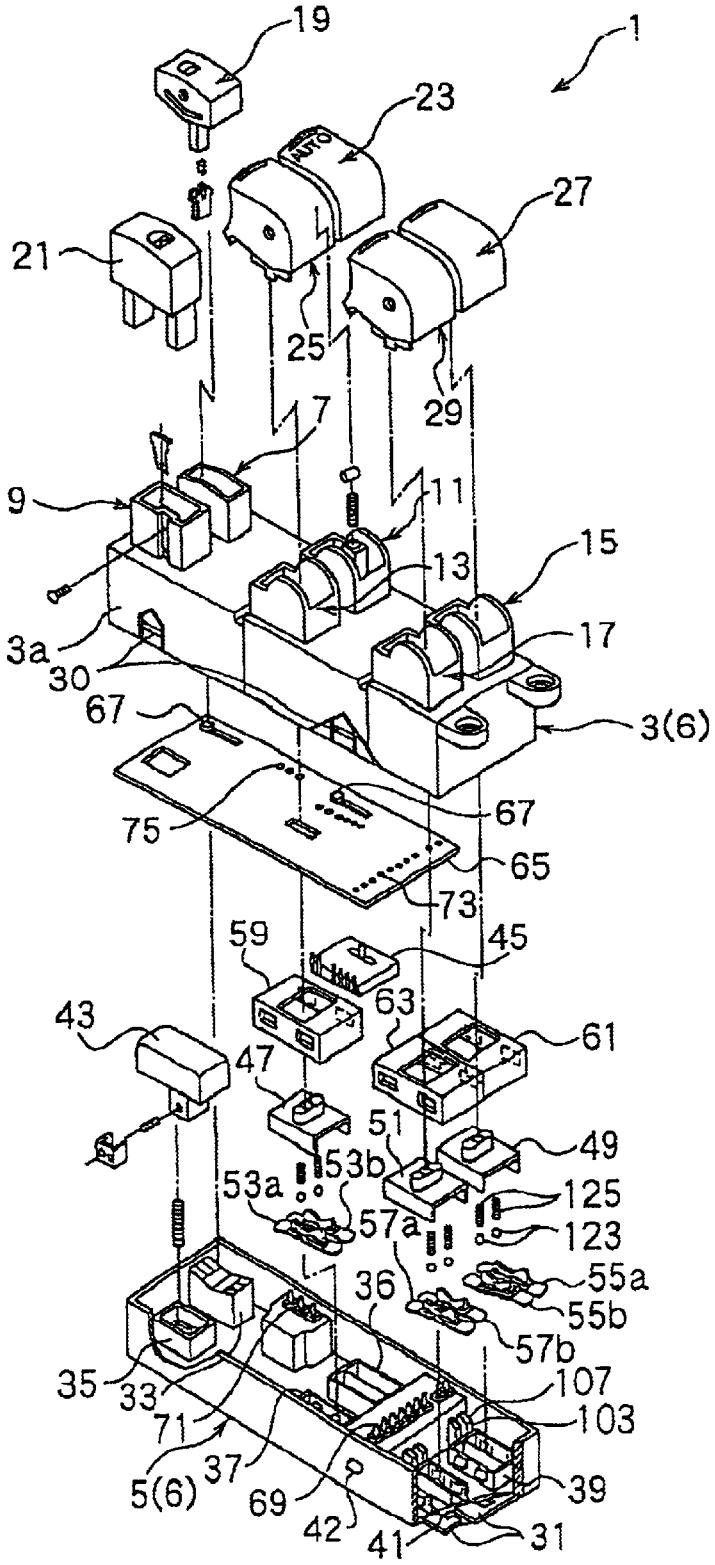
FIG. 1 is a disassembled perspective view of a power window switch to which an embodiment of the invention is applied.

FIG. 1 shows a disassembled perspective view of a power window switch 1 for, for example, for an automobile as a switch according to an embodiment of the invention. There is shown the power window switch 1 for an automobile of a right-hand drive vehicle, which is installed, for example, at an arm rest of a door at a driver seat or a vehicle compartment side of a door of an automobile. Further, a position and a direction of a respective portion or member, mentioned later, indicate a direction in the attached drawing, upper and lower directions, left and right directions and front and rear directions are changed by a state of attaching the power window switch 1 for an automobile to the automobile and are not limited to illustration. In the following, a detailed description will be given of the embodiment with an illustrated arbitrary state of the attached drawing as a reference.

The power window switch 1 for an automobile is provided with a case 3 and a terminal block 5. The case 3 and the terminal block 5 are coupled to each other to constitute a housing 6.

The case 3 is molded by resin, constituted by a shape of a box a lower face of a which is opened and an upper face thereof is provided with a plurality of knob attaching portions 7,9, 11, 13, 15, and 17. Each of left and right side walls 3*a* of the case 3 (only left side wall is shown in FIG. 1), is provided with engaging windows 30 at two locations thereof for attaching the case 3 to the terminal block 5 attachably and detachably. Switch knobs 19, 21, 23, 25, 27, and 29 are respectively supported by the respective knob attaching portion 7, 9, 11, 13, 15, and 17.

The switch knob 19 is a member for operating to lock the door, axially supported by the knob attaching portion 7 of the case 3 and attached to the case 3 pivotably. The switch knob 21 is a push lock switch integrated to the knob attaching portion 9 of the case 3 movably in the up and down direction for operating to lock the window. The switch knob 23 is a two stages seesaw type switch axially supported by the knob attaching portion 11 of the case 3 and attached pivotably to the case 3 for operating to the open and close window of the driver seat.

The switch knob 25 is a seesaw type switch to which an embodiment of the invention is applied, axially supported by the knob attaching portion 13 of the case 3 and pivotably attached to the case 3 for operating to open and close the window on the front passenger seat side. The switch knob 27 is a seesaw type switch to which the embodiment of the invention is applied, axially supported by the knob attaching portion 15 of the case 3 and pivotably attached to the case 3 for operating to open and close the window on the rear passenger drive seat side. The switch knob 29 is a seesaw type switch to which the embodiment of the invention is applied, axially supported by the knob attaching portion 17 of the case 3 and pivotably attached to the case 3 for operating to open and close the window on the rear passenger seat side opposed to the rear passenger driver side.

The terminal block 5 is insert-molded with a plurality of conductive boards 31 conducted to terminals and fixed contacts by insulating resin. The terminal block 5 is respectively provided with a fixed contact support portion 33 in correspondence with the switch knob 19, a containing wall portion 35 in correspondence with the switch knob 21, a containing wall portion 36 in correspondence with the switch knob 23, a containing wall portion 37 in correspondence with the switch knob 25, a containing wall portion 39 in correspondence with the switch knob 27, and a containing wall portion 41 in correspondence with the switch knob 29.

The containing wall portion 35 is arranged with a moving block 43, the containing wall portion 36 is arranged with an auto switch 45, and the containing wall portions 37, 39, and 41 are respectively arranged with sliders 47, 49, and 51.

The slider 47 is contained in the containing wall portion 37 along with a pair of movable pieces 53*a* and 53*b* and a slider cover 59 is attached to the containing wall portion 37 attachably and detachably. Similarly, the slider 49 is contained in the containing wall portion 39 along with a pair of movable pieces 55*a* and 55*b* and a slider cover 61 is attached to the containing wall portion 39 attachably and detachably. Also the slider 51 is contained in the containing wall portion 41 along with a pair of movable pieces 57*a* and 57*b* and a slider cover 63 is attached to the containing wall portion 41 attachably and detachably. There is constituted a structure in which the switch knobs 25, 27 and 29 correspondingly corporate with the sliders 47, 49 and 51.

That is, the sliders 47, 49 and 51 support elastic contact members, mentioned later, and are moved by pivoting operation of the switch knobs 25, 27 and 29. Further, the slider covers 59, 61 and 63 are constructed by a constitution of being respectively attached to the containing wall portions 37 and 39 and 41, forming containing spaces, mentioned later, for respectively containing the sliders 47, 49 and 51 and the movable pieces 53*a*, 53*b*, 55*a*, 55*b*, 57*a*, and 57*b* between the slider covers 59, 61 and 63 and the containing wall portions 37, 39 and 41 and covering the sliders 47, 49 and 51 movably in the front and rear direction.

The terminal block 5 is provided with engaging projections 42 respectively at two locations of left and right wall faces thereof for engaging with the engaging windows 30 of the case 3. However, in FIG. 1, only the engaging projection 42 is shown at one location of the left wall.

A circuit board 65 is supported above the terminal block 5. A light emitting diode (LED) 67 or a lamp is provided at the circuit board 65 as a light source. The circuit board 65 is fitted to an upper opening portion of the terminal block 5. Terminals 69 and 71 projected from the terminal block 5 in the upper direction are inserted into through holes 73 and 75 and the terminals 69 and 71 are soldered to the through holes 73 and 75 to thereby fix the circuit board 65 to the terminal block 5.

Figure 2:
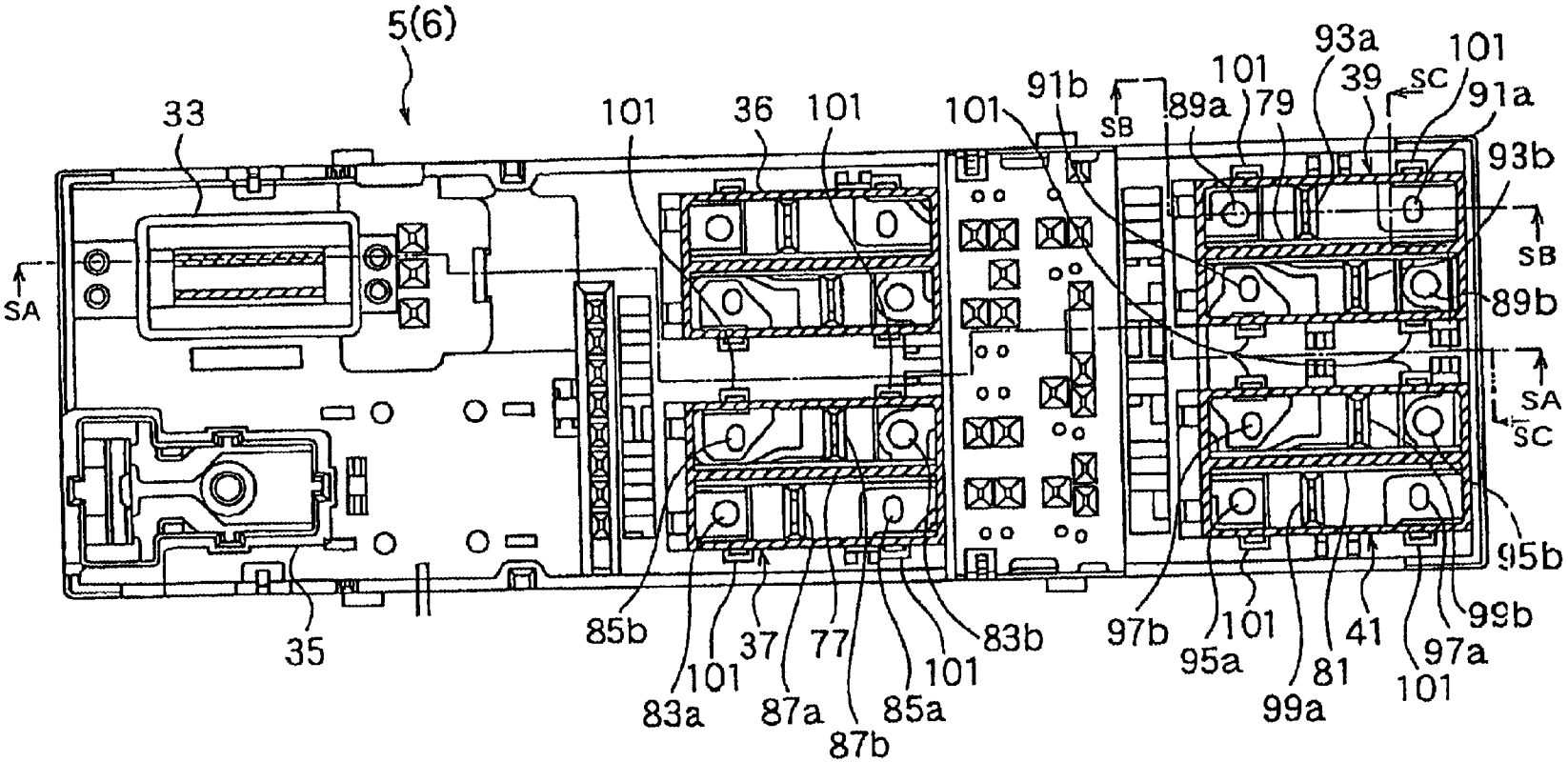
FIG. 2 is a plane view of a terminal block according to the embodiment.
Figure 3:
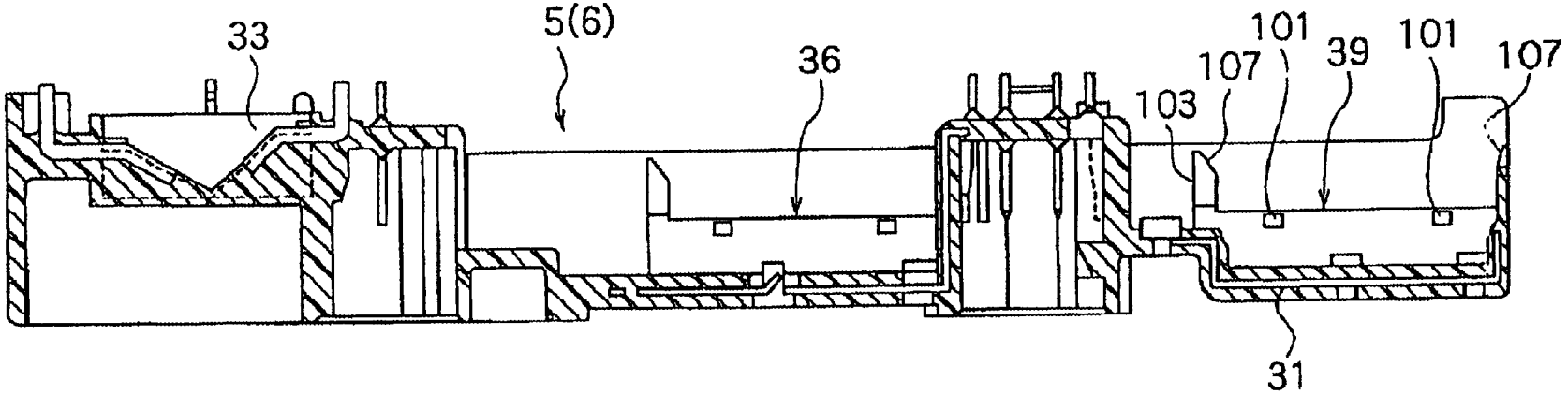
FIG. 3 is a sectional view taken along a line SA—SA of FIG. 2 according to the embodiment.

FIG. 2 shows a plane view of the terminal block 5 and FIG. 3 shows a sectional view taken along a line SA—SA of FIG. 2. As shown by FIG. 2 and FIG. 3, the containing wall portion 37, 39 and 41 are constructed by substantially the same constitution and are partitioned into left and right portions respectively by middle walls 77, 79 and 81.

Left sides (lower sides in FIG. 2) of the middle walls 77 and 81 of the containing wall portions 37 and 41 contain contacts for lifting and right sides thereof contain contacts for lowering. A left side (lower side in FIG. 2) of the middle wall 79 of the containing wall portion 39 contains a contact for lowering and a right side thereof contains a contact for lifting. That is, fixed contacts 83*a* and 83*b*, fixed contact portions 85*a* and 85*b*, and fulcrum serving fixed contacts 87*a* and 87*b* are respectively provided on left and right sides of inside of the containing wall portion 37. Similarly, fixed contacts 89*a* and 89*b*, fixed contact portions 91*a* and 91*b* and fulcrum serving fixed contacts 93*a* and 93*b* are provided at inside of the containing wall portion 39. Fixed contacts 95*a* and 95*b*, fixed contact portions 97*a* and 97*b*, and fulcrum serving fixed contacts 99*a* and 99*b* are provided at inside of the containing wall portion 41. The fixed contacts 83*a*, 83*b*, 89*a*, 89*b*, 95*a*, and 95*b*, the fulcrum serving fixed contacts 87*a*, 87*b*, 93*a*, 93*b*, 99*a*, and 99*b*, and the fixed contact portions 85*a*, 85*b*, 91*a*, 91*b*, 97*a*, and 97*b*, are pertinently conducted to the conductive members 31 for constituting a switch circuit. There are provided engaging claws 101 for engaging and detaching the slider covers 59, 61 and 63 at left and right outer wall faces of the containing wall portions 37, 39 and 41.

Figure 4:
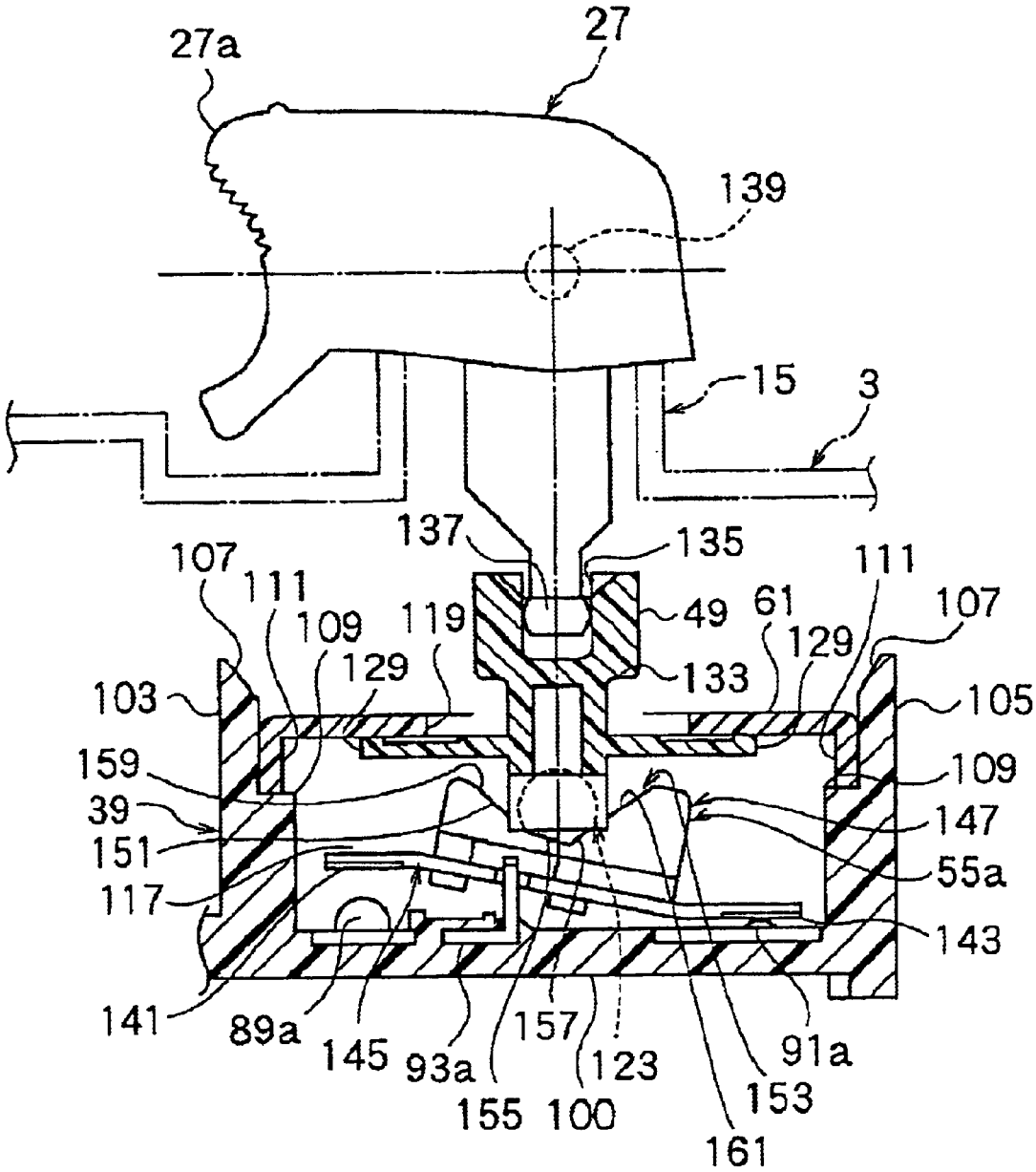
FIG. 4 is a partially omitted sectional view of essential portions of an integrating state taken along a line SB—SB of FIG. 2 according to the embodiment.
Figure 5:
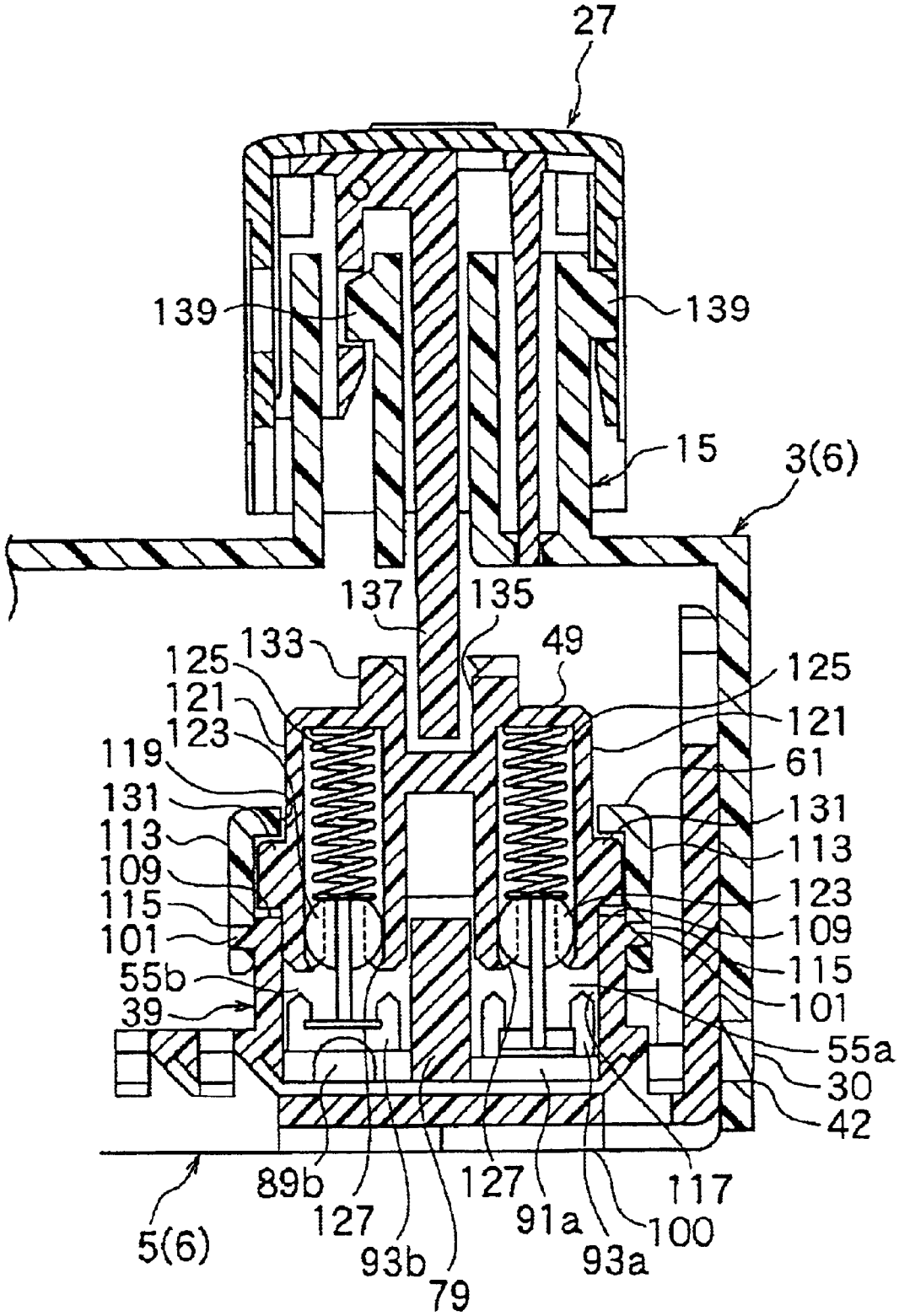
FIG. 5 is a sectional view of essential portions in the integrating state taken along a line SC—SC of FIG. 2 according to the embodiment.

FIG. 4 is a partially omitted sectional view of essential portions of an integrated state taken along a line SB—SB of FIG. 2 and FIG. 5 is a sectional view of essential portions in the integrated state taken along a line SC—SC. An explanation will be given further of details of the seesaw type switch according to the embodiment of the invention in reference to FIG. 4 and FIG. 5. Further, although FIG. 4 and FIG. 5 show sections at the containing wall portion 39, constitutions of the seesaw type switch in the other containing wall portions 37 and 41 are substantially similar and therefore, an explanation will be given of the sectional views of FIG. 4 and FIG. 5 as a representative of all.

As shown by FIG. 4 and FIG. 5, the fixed contacts 89*a* and 89*b*, the fixed contact portions 91*a* and 91*b*, and the fulcrum serving fixed contacts 93*a* and 93*b* are supported by a bottom wall 100 of the containing wall portion 39. A guide portion 103 is projected upwardly from one side of the containing wall portion 39. A guide face 107 is formed to incline at the guide portion 103. A guide wall 105 is provided at the containing wall portion 39 on a side thereof opposed to the guide portion 103. The guide face 107 is formed to incline also at the guide wall 105. Cover support faces 109 are provided on inner sides of the guide portion 103 and the guide wall 105 and front and rear sides of the containing wall portion 39. There is constituted a structure in which front and rear wall portions 111 of the slider cover 61 are brought into contact with the cover support faces 109.

The slider cover 61 is molded by resin. As is apparent also in reference to a disassembled sectional view of FIG. 6, the slider cover 61 is provided with two pieces of engaging holes 115 respectively at left and right wall portion 113. The engaging hole 115 is engaged with the engaging claw 101 of the containing wall portion 39 by being guided by the guided face 107 by pushing the slider 61 into the containing wall portion 39. Therefore, the slider cover 61 is attachably and detachably attached to the containing wall portion 39. Thereby, a containing space 117 is formed between the containing wall portion 39 and the slider cover 61. The slider 49 and the movable pieces 55*a* and 55*b* are contained in the containing space 117. The slider cover 61 is provided with a window 119.

The slider 49 is molded by resin and slider 49 is provided with a pair of left and right ball support portions 121. The ball support portions 121 each is contained with a steel ball 123 as an elastic contact member via a coil spring 125 as an urging member and is provided with an opening 127 at an end portion thereof.

The slider 49 is projected with a slider plate portion 129 in the front and rear direction on the lower face side of the slider cover 61. By the slider plate portion 129, dust and dirt can be prevented from invading from the window 119 into the containing wall portion 39. Slider projections 131 are projected from left and right sides of the slider 49. The slider projection 131 is interposed between a cover support face 109 of the containing wall portion 39 and the lower face of the slider cover 61 to be guided slidingly.

The slider 49 is provided with a head portion 133. The head portion 133 is projected from the window 119 of the slider cover 61 to the side of the switch knob 27 along with upper portion sides of the ball support portions 121. The head portion 133 is provided with an operating recessed portion 135. An operating lever portion 137 of the switch knob 27 is fitted to the operating recessed portion 135.

The switch knob 27 is axially supported by projected portions 139 of the knob attaching portion 15. That is, the switch knob 27 is constructed by a constitution of being pivotably supported by the housing 6 for moving the slider 49 to thereby operate to move the steel ball 123 as the elastic contact member which is brought into elastic contact with the movable pieces 55*a* and 55*b*.

A movable piece 55*a* is pivotably supported by the fulcrum serving fixed contact 93*a*. A movable contact 141 is provided on one side in the front and rear direction of the movable pieces 55*a* and a movable contact portion 143 is provided on other side thereof. The movable contact 141 is constructed by a constitution of being brought into contact with and detached from the fixed contact 89*a* by pivoting movement of the movable piece 55*a*.

The steel ball 123 of the slider 49 is constructed by a constitution of pivoting the movable piece 55*a* by moving on the movable piece 55*a* and bringing and detaching the movable contact 141 into contact with and from the fixed contact 89*a*. A further explanation will be given of a structure of the movable piece 55*a* and a periphery thereof in reference to FIG. 7 through FIG. 10.

Figure 7:
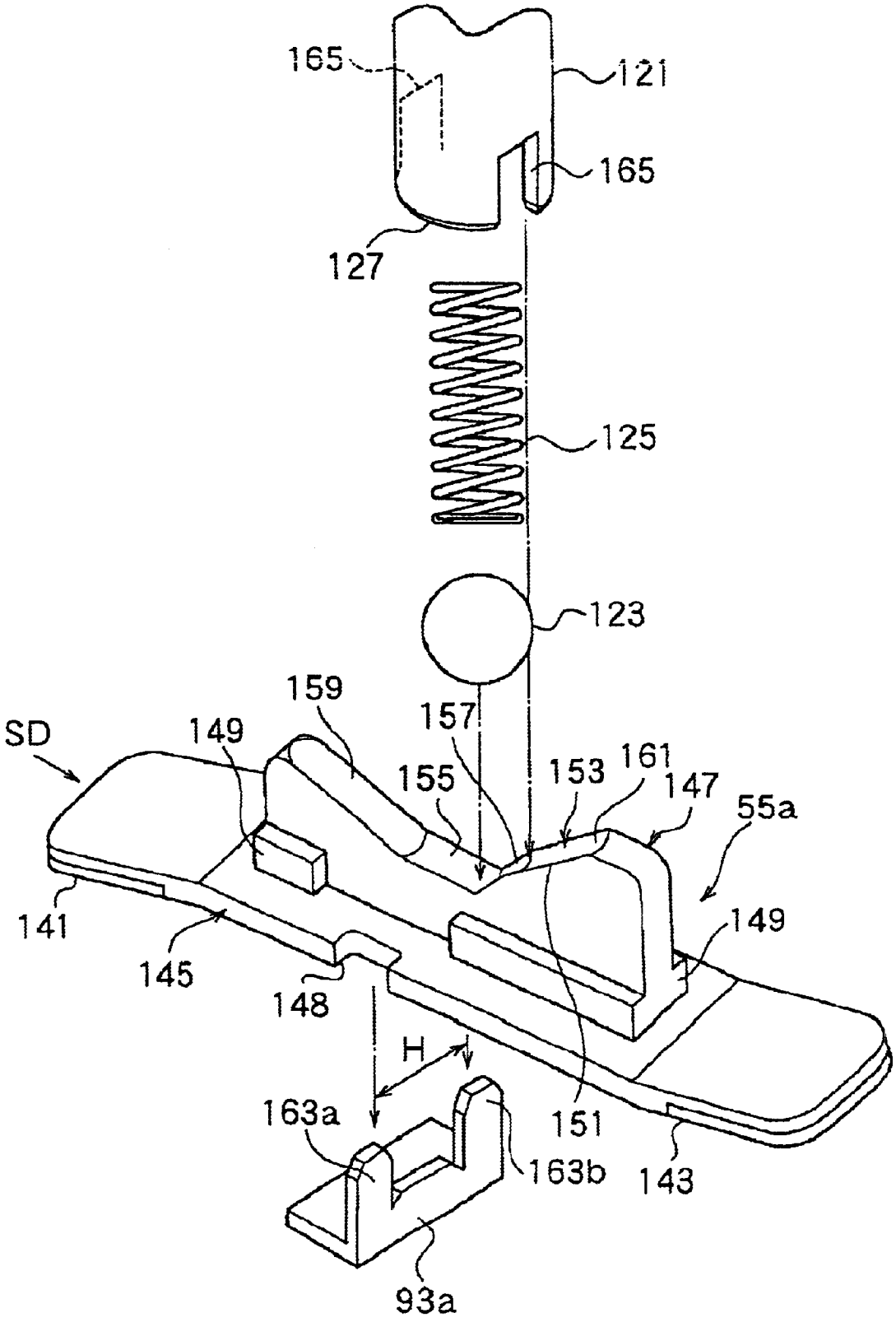
FIG. 7 is a disassembled perspective view of a movable piece and a periphery thereof according to the embodiment.
Figure 8:
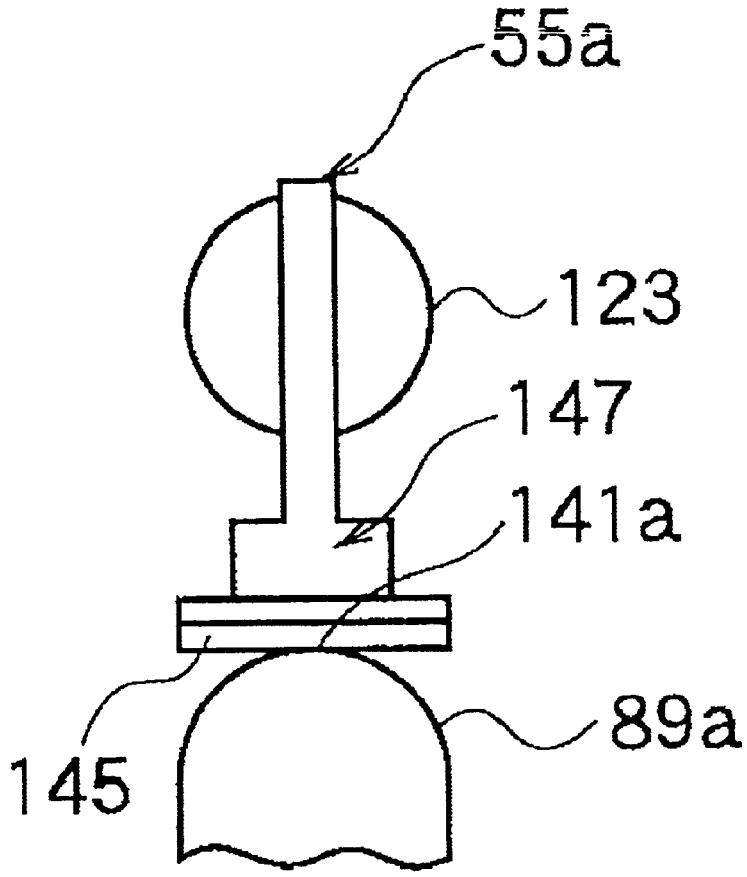
FIG. 8 is an outline side view of a state in which a contact point is brought into contact viewed from a direction of SD of FIG. 7 according to the embodiment.
Figure 9:
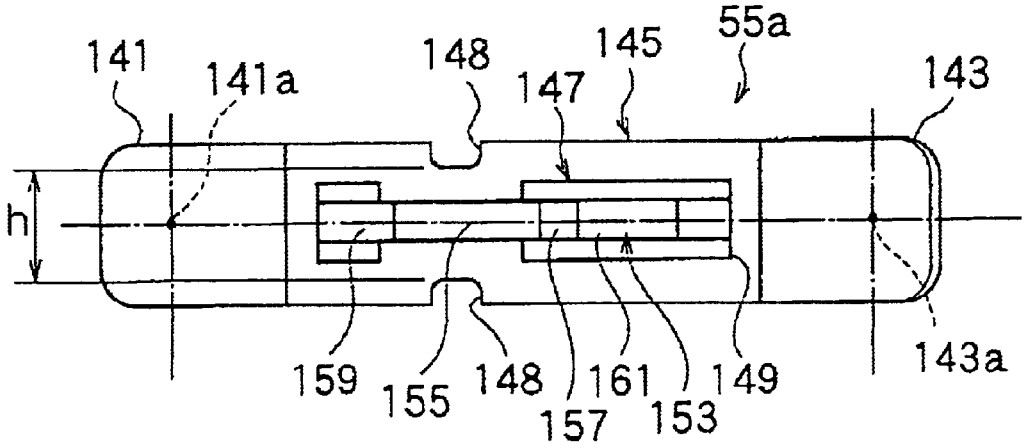
FIG. 9 is a plane view of a movable piece according to the embodiment.
Figure 10:
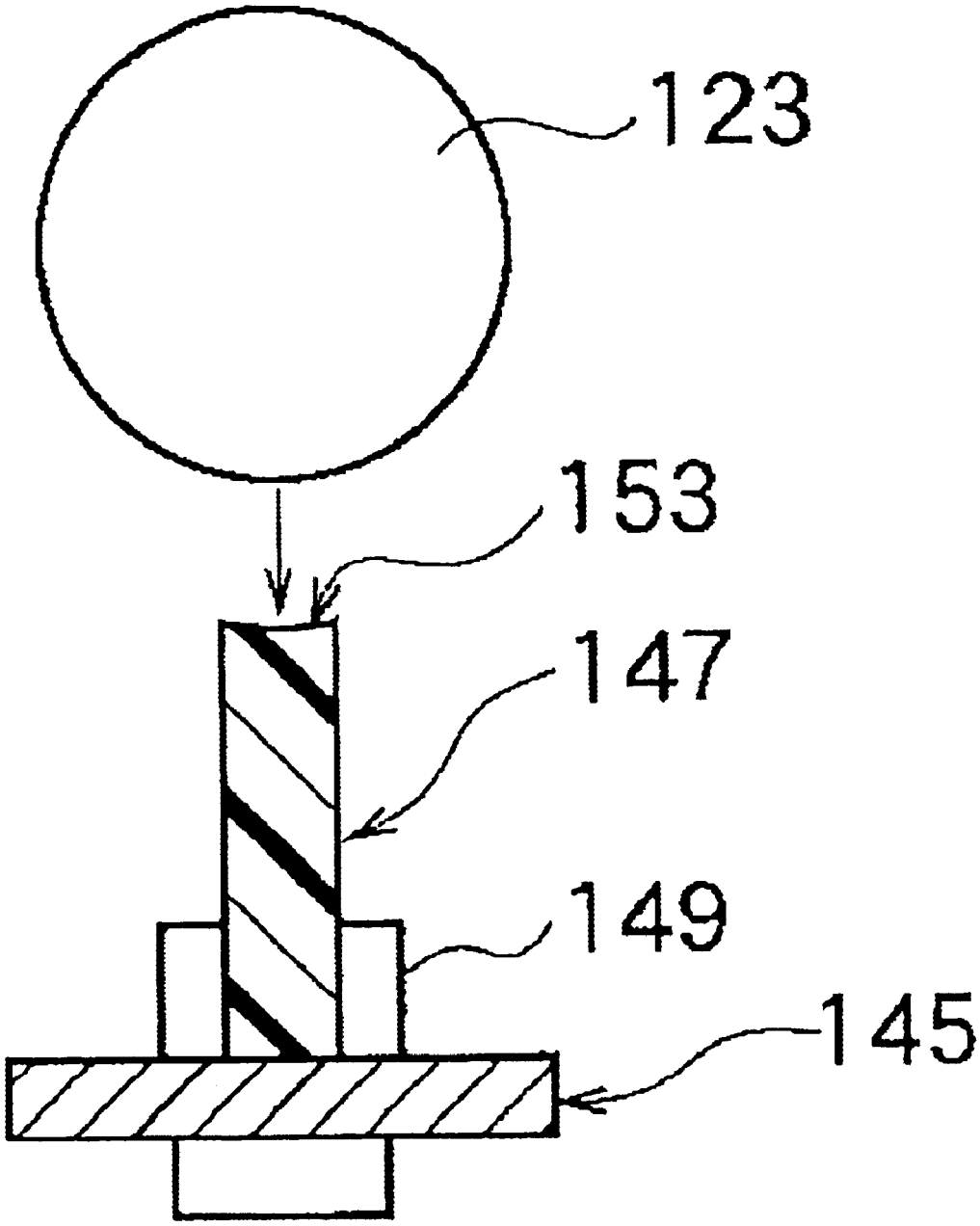
FIG. 10 is a sectional view showing a relationship between a movable piece and a steel ball according to the embodiment.

FIG. 7 is a disassembled perspective view of the structure of the movable piece 55*a* and the periphery, FIG. 8 is a side view of a state of bringing the contact into contact viewed from a direction of SD of FIG. 7, FIG. 9 is a plane view of a movable piece and FIG. 10 is a sectional view of the movable piece from in a relationship with the steel ball.

As shown by FIG. 7 through FIG. 10, the movable piece 55*a* is provided with a contact portion 145 and a click portion 147.

The contact portion 145 is made of a conductive material and is fabricated by pressing a plate material of a conductive metal of, for example, copper or the like. The contact portion 145 is formed in a flat plate shape as a whole except slight bending of the movable contact 141 and the movable contact portion 143 at both ends thereof. The movable contact 141 and the movable contact portion 143 are provided at lower faces of the both ends of the contact portion 145 by cladding thin plates of silver or the like or by silver plating. Silver is used in the movable contact 141 and the movable contact portion 143 to promote reliability of contact. A contact point 141*a* of the movable contact 141 (FIG. 8, FIG. 9) and a contact point 143*a* of the movable contact portion 143 (FIG. 9) are disposed on a line passing a center in a width direction of the contact portion 145 and a thickness direction of the click portion 147. The contact portion 145 is provided with a pivotal engaging recessed portion 148 slightly proximate to the movable contact 141 relative to a middle thereof. The pivotal engaging recessed portions 148 are provided on both sides in the width direction of the contact portion 145.

The click portion 147 is molded by resin integrally with the contact portion 145 made of the conductive material. The molding is carried out by fitting the contact portion 145 into a mold and making resin flow thereinto. The molding is facilitated since the contact portion 145 is formed in the flat plate shape as a whole. The click portion 147 is formed to be flat as a whole although a base portion 149 thereof is formed to be slightly wide in the width.

A click groove 153 is provided at an end edge 151 of the click portion 147 and grease is coated on the click groove 153. The click groove 153 gives a click in elastic contact movement of the steel ball 123 and provides a click feeling in operating the switch knob 27. The click groove 153 is formed by inclined faces 155 and 157 cut in a V-like shape at a center thereof and inclined faces 159 and 161 having slightly gradual inclinations frontward and rearward therefrom.

The click groove 153 is formed in a recessed shape of a curved face in a section thereof as shown by FIG. 10. The recessed shape of the click groove 153 is formed in accordance with an outer face in a spherical shape of the steel ball 123. Therefore, when the steel ball 123 is brought into elastic contact with the click groove 153, there is brought about a mode in which the spherical outer shape is fitted to the click groove 153 and the steel ball 123 can be restrained from being detached in the width direction of the click groove 153. Therefore, when the steel ball 123 is integrated to the click groove 153, even when a center line of the steel ball 123 is slightly shifted from a center line of the recessed shape of the click groove 153, the steel ball 123 is fitted to the recessed shape of the click groove 153 and therefore, the click portion 147 can be formed in the plate shape by shortening a lateral width thereof. The click portion 147 is molded by resin and therefore, a recessed shape having smooth surface can easily be molded by a mold by injection molding. Further, since the click portion 147 is molded by resin and the section of the click groove 153 is formed by the recessed shape, sliding movement of the mode click groove 153 relative to the steel ball 123 can be carried out further smoothly and operation feeling of the switch knob 27 can firmly be promoted.

The movable piece 55*a* is constructed by a constitution of being pivotably supported by the side of the terminal block constituting the housing by engaging the pivotable engaging recessed portions 148 to the fulcrum serving fixed contact 93*a*. That is, the fulcrum serving fixed contact 93*a* is provided with a pair of lock portions 163*a* and 163*b*. The lock portions 163*a* and 163*b* are provided with an interval H (FIG. 7) in correspondence with a distance h between the left and right pivotable engaging recessed portions 148 (FIG. 9). By such a mode, the movable piece 55*a* is mounted on and supported by the fulcrum serving fixed contact 93*a* and is made pivotable by engaging the respective pivotable engaging recessed portion 148 to the respective lock portions 163*a* and 163*b*.

According to the movable piece 55*a* having such a constitution, the click portion 147 is arranged to erect relative to the housing 6 toward the switch knob 27 such that the steel ball 123 is brought into elastic contact with the click groove 153. The ball support portion 121 of the slider 49 is provided with the fitting grooves 165 on front and rear sides. The fitting groove 165 is constructed by a constitution of being loosely fitted to the end edge 151 of the movable piece 55*a*.

Such a structure is similar also the side of the movable piece 55*b* provided in parallel with the movable piece 55*a*. However, in order to carry out lifting and lowering operation, on the side of the movable piece 55*b*, an arrangement relationship between the movable contact 141 and the fixed contact 89*b* and between the movable contact portion 143 and the fixed contact portion 91*b*, is reversed and in view from the state of FIG. 4, according to the movable piece 55*b*, the movable contact 141 and fixed contact 89*b* are disposed on the right side and the movable contact portion 143 and the fixed contact 91*b* are disposed on the left side.

Figure 11:
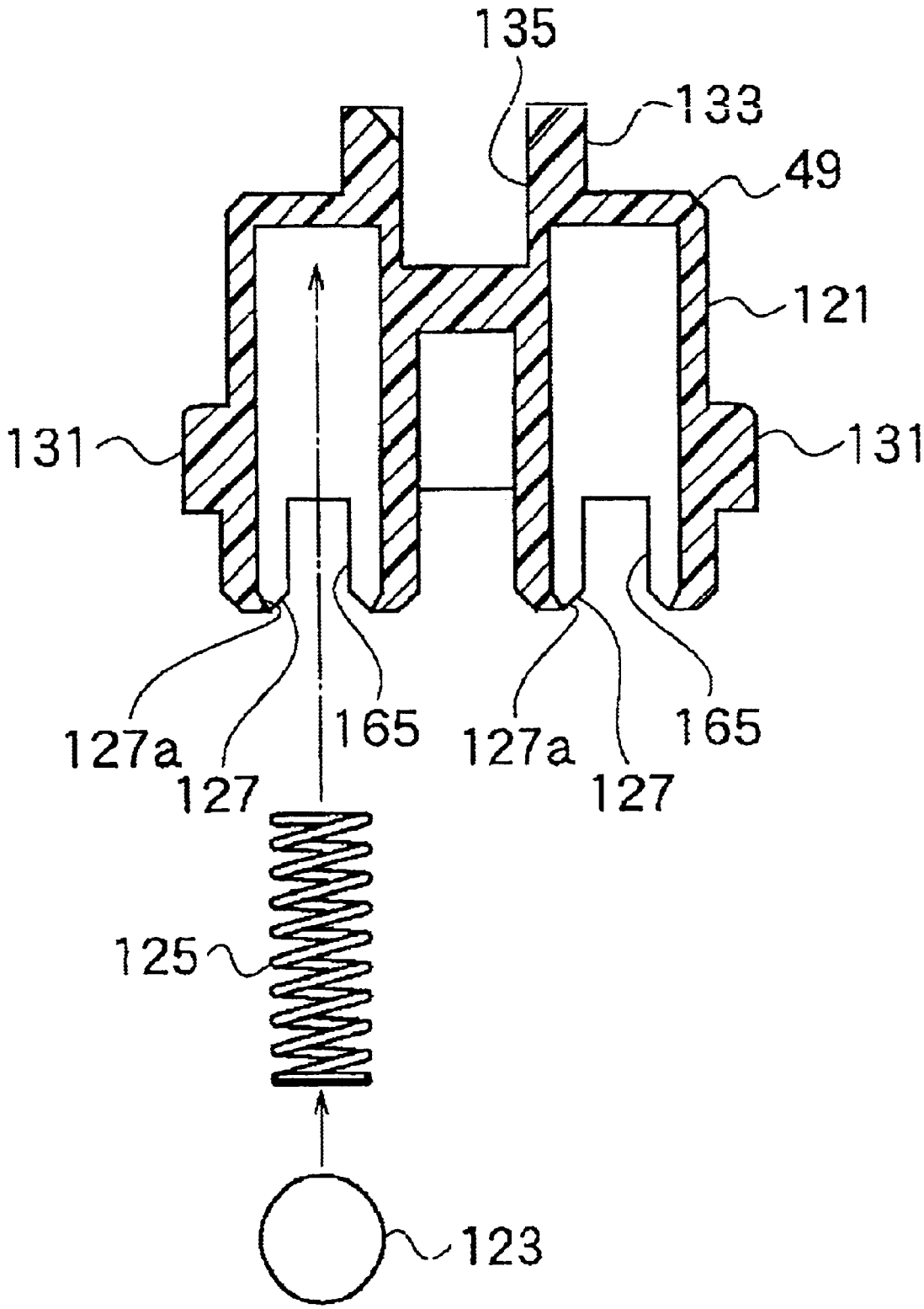
FIG. 11 is a sectional view showing a relationship between the slider and the steel ball according to the embodiment.
Figure 12:
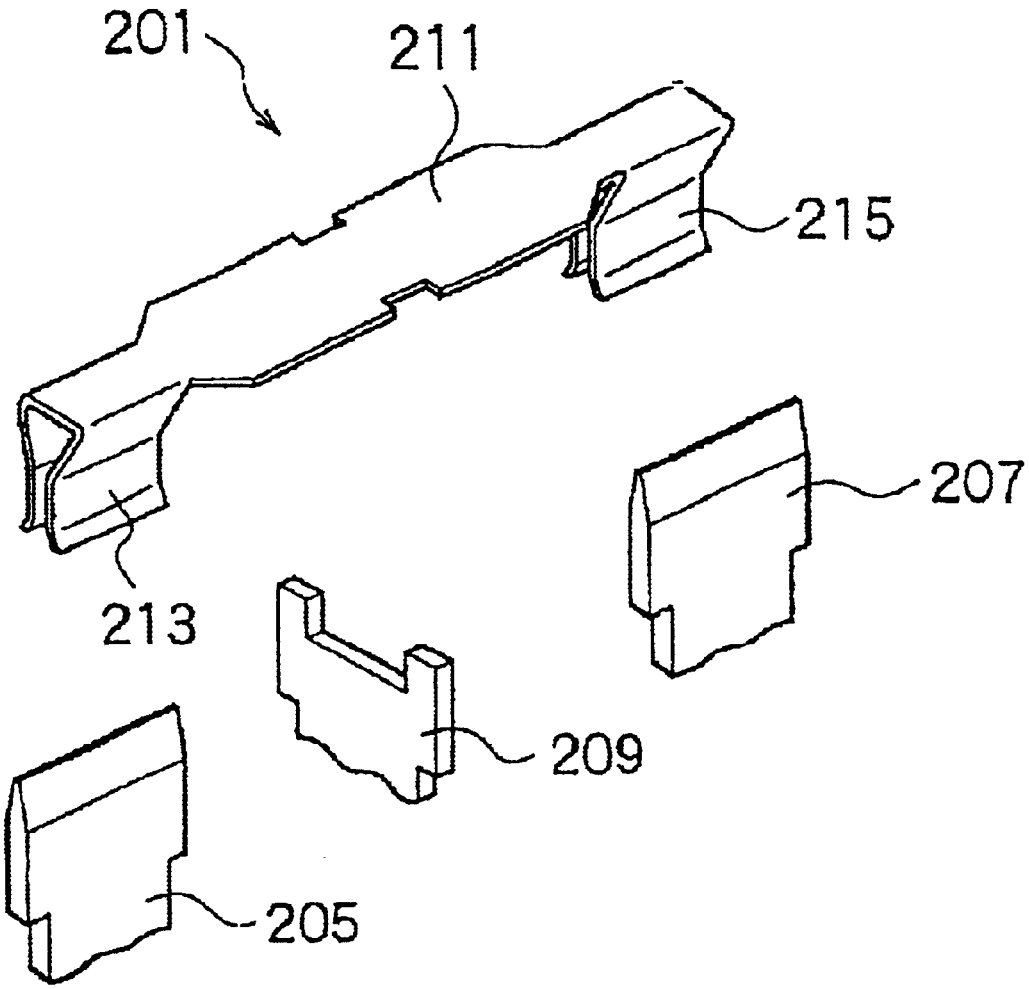
Fig.12 PRIOR ART
FIG. 12 is a disassembled perspective view showing a relationship between a fixed terminal and a movable terminal of a switch according to a conventional example.
Figure 13:
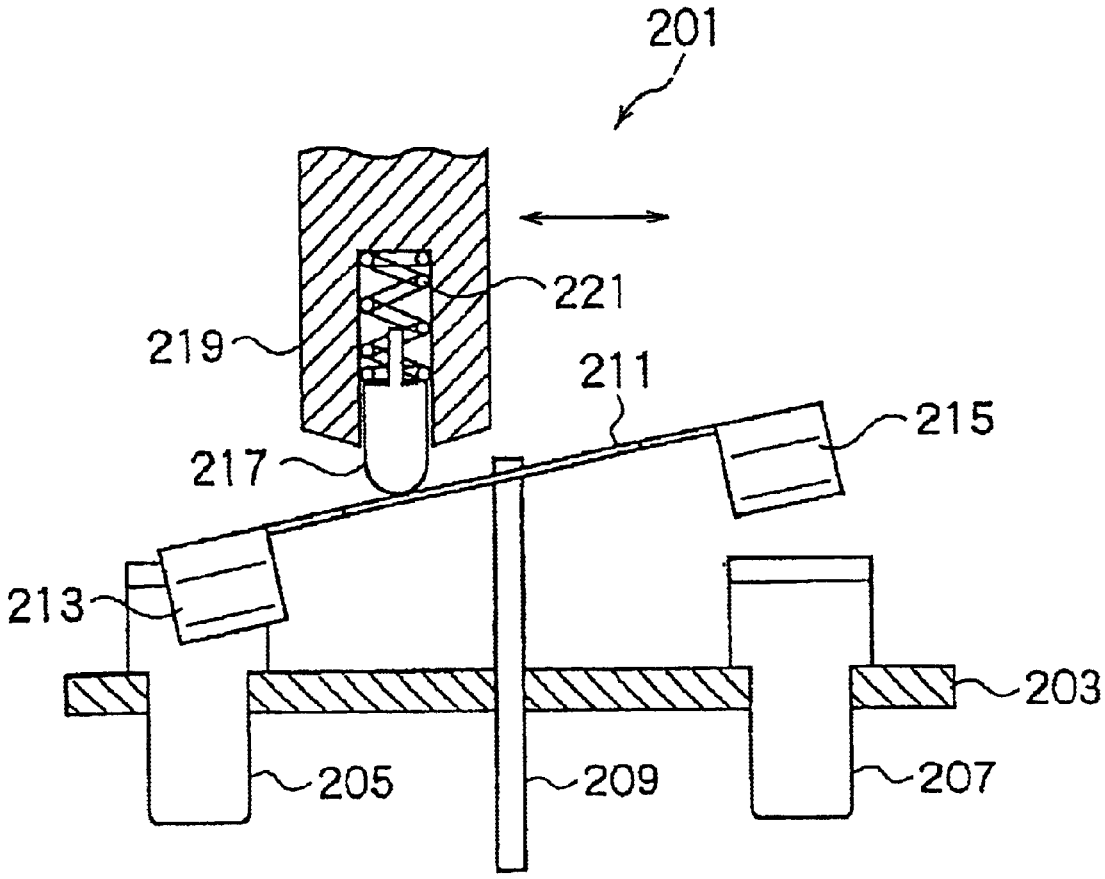
Fig.13 PRIOR ART
FIG. 13 is a sectional view of an integrated state according to the conventional example.

FIG. 11 shows a section of the slider 49. The opening 127 of the ball support portion 121 of the slider 49 is formed such that a diameter of an opening edge 127*a* thereof is formed to be smaller than a diameter of the steel ball 123. Therefore, there is constructed a constitution in which the steel ball 123 is contained to push into the opening 127 while elastically deforming the opening 127.

In integrating operation, as shown by FIG. 7, the movable piece 55*a* is pivotably supported by the fulcrum serving fixed contact 93*a*. The pivotable support is carried out by fitting and locking the pivotable engaging recessed portions 148 to the lock portions 163*a* and 163*b* of the fulcrum serving fixed contact 93*a*. In the pivotable support, there is a gravitational center on the side of the movable contact portion 143 with the fulcrum serving fixed contact 93*a* as a boundary and the movable contact portion 143 is brought into contact with the fixed contact portion 91*a* and is stabilized. The movable piece 55*b* is also contained similarly.

According to the slider 49, the respective coil spring 125 is inserted from the respective opening 127 of the respective ball support portion 121 and the respective steel ball 123 is pushed thereinto by predetermined push force. At this occasion, the opening edge 127*a* is expanded by pushing the steel ball 123 thereinto and is recovered to an original diameter by elastic force when the steel ball 123 is brought into the ball support portion 121. Therefore, although a portion of the steel ball 123 urged by the coil spring 125, is exposed from the opening 127, the steel ball 123 is not detached, the opening 127 to outside. Therefore, in integrating operation, by only grubbing the slider 49, the coil spring 125 and steel ball 123 can be handled integrally and integration is extremely easily. The steel ball 123 is always brought into press contact with the recessed shape of the click groove 153 and therefore, the movable piece 55*a* can be prevented from being detached by external force by pushing the movable piece 55*a* to the fulcrum serving fixed contacts 93*a* and 93*b*.

Figure 6:
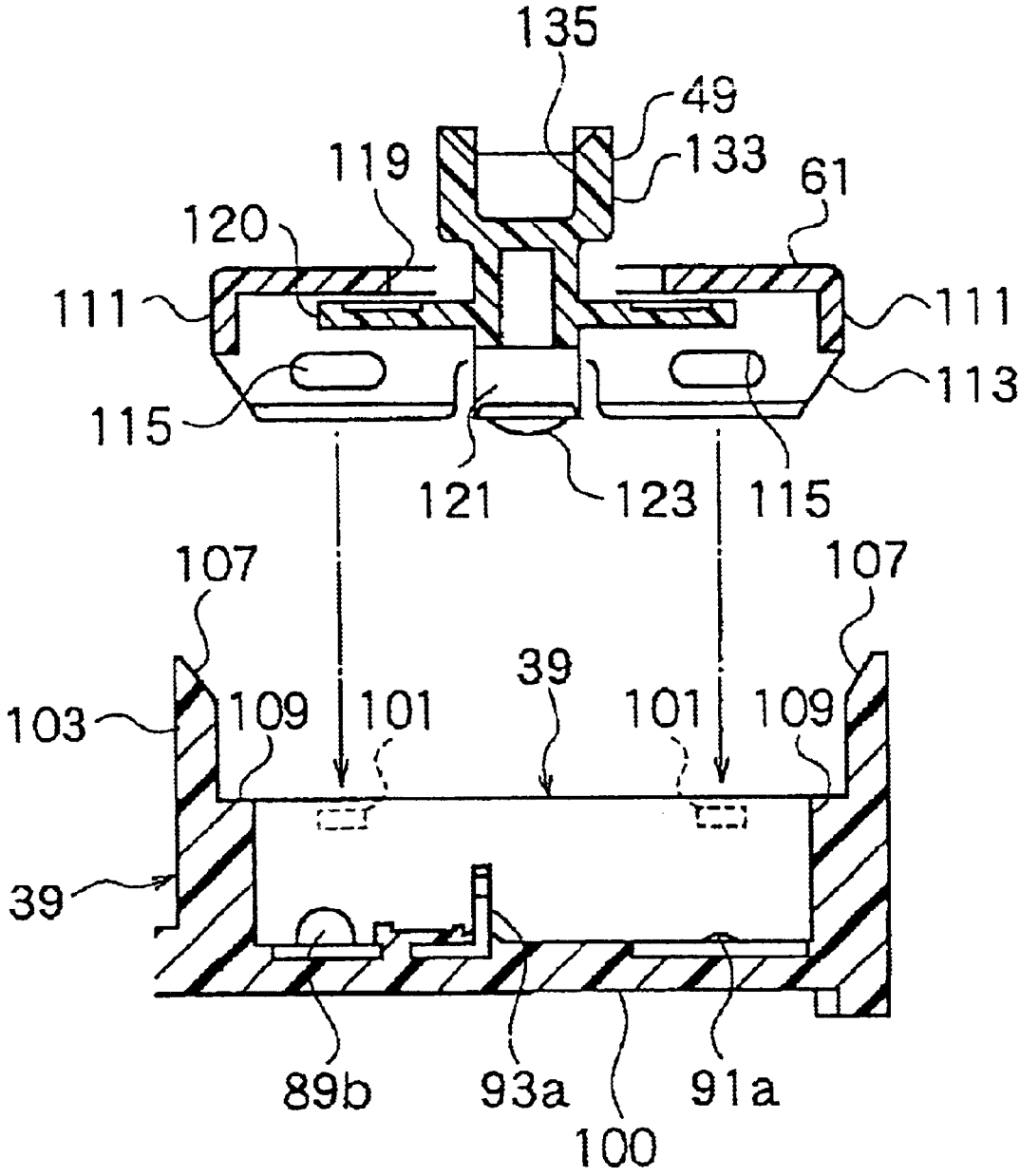
FIG. 6 is a disassembled sectional view showing a relationship of engaging the slider cover and a containing wall portion according to the embodiment.

The slider 49 is integrated as shown by FIG. 6 by making the head portion 133 face from the window 119 of the slider cover 61 along with the upper portion sides of the ball support portions 121. Although the movable pieces 55*a* and 55*b* are not shown in FIG. 6, the movable pieces 55*a* and 55*b* are pivotably supported by the fulcrum serving fixed contacts 93*a* and 93*b* as described above. Under the state, the slider 49 and slider cover 61 are lowered and the slider cover 61 is integrated onto the containing wall portion 39. In the integrating operation, the inclined face 107 constitutes a guide and the slider cover 61 can easily be integrated onto the containing wall portion 39. Thereby, the front and rear wall portion 111 of the slider cover 61 are brought into contact with the cover support faces 109 of the containing wall portion 39, the engaging hole 115 of the slider cover 61 is engaged with the engaging claw 101 of the containing wall portion 39 and the slider cover 61 is integrated onto the containing wall portion 39 as shown by FIG. 4 and FIG. 5.

In this way, the slider cover 61 is guided by the guide portion 103 and the guide wall 105 and is fixed to the containing wall portion 39 by the engaging claw 101 in one touch motion and therefore, when the slider cover 61 is integrated to the containing wall portion 39, as shown by FIG. 6, the slider cover 61 can be integrated thereto only by dropping and pushing the slider cover 61 to the containing wall portion 39 and automatic integration can simply be carried out by a machine.

Under the state, the respective steel balls 123 of the slider 49 are respectively brought into elastic contact between the inclined faces 155 and 157 of the movable pieces 55*a* and 55*b*. Further, there is brought about a state in which the respective fitting grooves 165 of the ball support portions 121 of the slider 49 are respectively fitted loosely to the end edges 151 of the movable pieces 55*a* and 55*b*.

In this way, the switch knob 27 and the movable pieces 55*a* and 55*b* are positioned to each other, on the side of the movable piece 55*a*, the movable contact 141 is detached from the fixed contact 89*a*, the movable contact portion 143 is brought into contact with the fixed contact portion 91*a* and switch operation is brought into a stand-by state at a neutral position thereof. At this occasion, as shown by FIG. 8, the contact point 143*a* of the movable contact portion 143 is disposed on the line passing the center in the width direction of the contact portion 145 and the thickness direction of the click portion 147 and therefore, force is balanced vertically and the movable piece 55*a* is brought into a stable state. Also the side of the movable piece 55*b* is symmetrically brought into similar stand-by state.

The slider 47, the movable pieces 53*a* and 53*b*, the slider 51 and the movable pieces 57*a* and 57*b* and the like are integrated by a similar relationship in accordance with the fixed contacts 83*a*, 83*b*, 95*a* and 95*b*. Further, the moving block 43, the auto switch 45 and the like are integrated.

The slider covers 59, 61 and 63, the sliders 47, 49 and 51, the coil springs 125, the steel balls 123, the movable pieces 53*a*, 53*b*, 55*a*, 55*b*, 57*a* and 57*b*, the containing wall portions 37, 39 and 41 and the fixed contacts 83*a*, 83*b*, 89*a*, 89*b*, 95*a* and 95*b*, constitute small-sized switches similar to the auto switch 45. The slider covers 59, 61 and 63 constitute upper cases of the respective small-sized switches. The containing wall portions 37, 39 and 41 constitute three lower cases of the respective small-sized switches. The fixed contacts 83*a*, 83*b*, 89*a*, 89*b*, 95*a* and 95*b* and the containing wall portions 37, 39 and 41 constituting pole disks of the three small-sized switches, are insert-molded to the terminal block 5 comprising a single member, the terminal block 5 serves also as the lower cases and the pole disks of the respective small-sized switches and therefore, a number of parts and a number of integrating steps can significantly be reduced and cost can be reduced.

Next, the circuit board 65 is fitted to the opening portion of the terminal block 5 and the terminals 69 and 71 are inserted into and fixedly soldered to the through holes 73 and 75. The switch knobs 19, 21, 23, 25, 27 and 29 are respectively supported by the knob attaching portions 7, 9, 11, 13, 15 and 17 of the case 3. By fitting the case 7 from above the terminal block 5 and engaging the respective engaging windows 30 of the case 3 to the engaging projections 42 of the terminal block 5, the integrating operation is finished.

According to the integrated state, when, for example, a portion of the switch knob 27 is shown, as shown by FIG. 4, there is brought about a cooperating state capable of carrying out switching operation by fitting the operating lever portion 137 into the operating recessed portion 135 of the slider 49. The relationship is similar to relationships between the switch knobs 25 and 29 and the sliders 47 and 51.

Next, a description will be given of switching operation. The switching operation is similar in the switch knobs 25, 27 and 29 and therefore, an explanation will be given of the switch knob 27. When the power window is lifted by the switch knob 27, an operating portion 27*a* of the switch knob 27 is pulled up and the switch knob 27 is rotated in the clockwise direction in FIG. 4. Thereby, the operating lever portion 137 is engaged with the operating recessed portion 135 and moves the slider 49 in the left direction in FIG. 4. The steel ball 123 is moved from the inclined face 155 to the inclined face 159 in the click groove 153 and pivots the movable piece 55*a* in the counterclockwise direction centering on the fulcrum serving fixed contact 93*a*. By the pivoting movement, the movable contact 141 is brought into contact with the fixed contact 89*a*, there is constituted a closed circuit of the fixed contact 89*a*, the movable contact 141, the contact portion 145 and the fulcrum serving fixed contact 93*a* and the power window can be lifted.

In moving the slider 49, there is maintained a state in which the fitting groove 165 (FIG. 7) of the ball support portion 121 of the slider 49 is loosely fitted to the end edge 151 of the movable piece 55*a* and therefore, the steel ball 123 can be prevented from being detached from the ball support portion 121 and sideway fall of the movable piece 55*a* can also be prevented. Further, when the steel ball 123 is brought into elastic contact with the click groove 153, there is brought about a mode in which the spherical outer face is fitted to the face of the click groove 153 in the recessed shape and also in this respect, the steel ball 123 can be restrained from being detached in the width direction of the click groove 153 and the steel ball 123 can be prevented from being brought into press contact with the end edge 151 to thereby increase friction resistance.

When the movable contact 141 is brought into contact with the fixed contact 89*a*, by elastic contact of the steel ball 123 by way of urging by the coil spring 125, predetermined contact pressure is maintained and contact between the movable contact 141 and the fixed contact 89*a* can firmly be maintained. At this occasion, as shown by FIG. 8, the relationship among the steel ball 123, the movable piece 55*a* and the fixed contact 89*a*, becomes a state of a straight line passing through the center in the width direction of the contact portion 145 and the thickness direction of the click portion 147 and therefore, the reactive force from the fixed contact 89*a* can be operated along the click portion 147. Therefore, the urge force of the steel ball 123 and the reactive force from the fixed contact 89*a* are cancelled by each other substantially at the center in the thickness of the click portion 147, fall of the movable piece 55*a* can be restrained further firmly, play can be prevented and contact between the movable contact 141 and the fixed contact 89*a* can be carried out further firmly.

When the hand is separated from the switch knob 27, by the urge force of the coil spring 125, the steel ball 123 automatically return from the inclined face 159 to between the inclined faces 155 and 157. By the returning operation, there is brought about a state in which the movable contact 141 is separated from the fixed contact 89*a* as shown by FIG. 4 by operation reverse to the above-described and there is brought about a neutral state in which the movable contact portion 143 is brought into contact with the fixed contact portion 91*a*. The state can firmly be maintained by bringing the steel ball 123 between the inclined faces 155 and 157 cut in the V-like shape having large inclinations. Further, by such setting of the inclined faces 155 and 157, the click feeling of operation of the switch knob 27 can firmly be brought about.

Although when the steel ball 123 is shifted between the inclined faces 155 and 157, there is brought about a state in which the ball 123 is projected further from the opening 127 of the ball support portion 121, also in such a case, there is maintained a state in which the fitting groove 165 (FIG. 7) of the ball support portion 121 of the slider 49 is loosely fitted to the end edge 151 of the movable piece 55*a* and therefore, fall of the movable piece 55*a* and detachment of the steel ball 123 from the ball support portion 121 can be prevented.

When the power window is lowered, the operating portion 27*a* of the switch knob 27 is pressed and the switch knob 27 is rotated in the counterclockwise direction in the state of FIG. 4. At this occasion, the slider 49 is moved in the right direction in FIG. 4 and the steel ball 123 is moved from the inclined face 157 to the inclined face 161 on the side of the movable contact portion 143. Regardless of the movement, the movable contact portion 143 maintains the state of being brought into contact with the fixed contact portion 91*a*, that is, the movable piece 55*a* maintains the state of FIG. 4.

Further, even in such a case, the fitting groove 165 of the ball support portion 121 maintains the state of being loosely fitted to the end edge 151 of the movable piece 55*a* and fall of the movable piece 55*a* and detachment of the steel ball 123 can firmly be prevented similar to the above-described. Further, the relationship among the steel ball 123, the movable piece 55*a* and the fixed contact portion 91*a*, becomes the straight line condition similar to the above-described and therefore, there can be achieved the effect of canceling the reactive force similar to the above-described.

Under the state, although on the side of the movable piece of 55*a*, the movable contact 141 stays to be separated from the fixed contact 89*a*, on the side of the movable piece 55*b* aligned substantially symmetrically to the movable piece 55*a*, there is carried out a movement reverse to the that of the movable piece 55*a*, the movable contact 141 of the movable piece 55*b* is brought into contact with the fixed contact 89*b* to thereby form a closed circuit similar to the above-described and the power window can be lowered.

Further, when the finger is separated from the switch knob 27, the switch knob 27 automatically returns similar to the above-described, the steel ball 123 is disposed between the inclined faces 155 and 157 of the click groove 153 and the stand-by state of operation is recovered at the neutral position. Under the state, the movable contact portion 143 of the movable piece 55*b* is brought into contact with the fixed contact portion 91*b*.

Further, the circuit of the movable contact portion 143 and the fixed contact portion 91*a* and 91*b*, is utilized at the closed circuit of lifting and lowering when there is operated the switch knob provided at the front passenger side door or the rear seat door.

As described above, the movable pieces 53*a*, 53*b*, 55*a*, 55*b*, 57*a* and 57*b* are provided with the contact portions 145 made of the contact material and the click portions 147 made of resin having the click grooves 153 and therefore, the click grooves 153 can be formed easily at the click portions 147 on sides of the movable contacts 141. Further, the click groove 153 is provided at the click portion 147 made of resin and therefore, a degree of freedom of setting height and shape of the click groove 153 can considerably be widened, particularly, the flat click portion 147 is arranged to erect relative to the housing 6 and therefore, the degree of freedom can firmly be widened. The click groove 153 is provided at the click portion 147 made of resin and therefore, contact with the elastic contact member can smoothly be carried out without providing special surface finish and promotion of operation feeling of the switch knob can be achieved without increasing cost.

The click portion 147 is arranged to erect relative to the housing 6 toward the switch knobs 25, 27 and 29 such that the steel ball 123 is brought into elastic contact with the click groove 153 and therefore, by significantly reducing spaces in the width direction occupied by the movable pieces 53*a*, 53*b*, 55*a*, 55*b*, 57*a* and 57*b*, a plurality of the movable pieces 53*a*, 53*b*, 55*a*, 55*b*, 57*a* and 57*b* can be aligned in parallel and the switch can be downsized in the width direction. Particularly, when the switch is installed at the arm rest as in the power window switch for an automobile, from request of ensuring a space in the width direction of the vehicle compartment, it is necessary to reduce the space in the width direction as small as possible and there is provided the switch which is extremely advantageous in such a case.

By the end edge 151 of the movable pieces 53*a*, 53*b*, 55*a*, 55*b*, 57*a* or 57*b*, the opening 127 of the ball support portion 121 can be closed, the steel ball 123 can be prevented from being detached from the ball support portion 121 in moving on the movable piece 53*a*, 53*b*, 55*a*, 57*a*, or 57*b* and fall of the movable pieces 53*a*, 53*b*, 55*a*, 55*b*, 57*a*, and 57*b* can be restrained. In this way, pivoting movement of the movable pieces 53*a*, 53*b*, 55*a*, 55*b*, 57*a*, and 57*b* can firmly be carried out and contact and detachment of the movable contact 141 to and from the fixed contact 83*a*, 83*b*, 89*a*, 89*b*, 95*a*, or 95*b* can be carried out further firmly.

Further, since the steel ball 123 is formed by the spherical shape, friction coefficient is small, the steel ball 123 is inexpensive, hard and excellent in durability in comparison with a click pin made of resin and easy to fabricate and inexpensive owing to a standard product also in comparison with a click pin made of a metal. The click portion 147 of the movable piece 53*a*, 53*b*, 55*a*, 55*b*, 57*a*, or 57*b* fitted with the fitting groove of the ball support portion 121, is made of resin, surface roughness thereof is small and the surface is smooth even without finishing the surface, abrasion powder by contact of a metal is not brought about and therefore, the movement between the ball support portion 121 and the movable piece 53*a*, 53*b*, 55*a*, 55*b*, 57*a*, or 57*b* can be made smooth, durability of the movable piece 53*a*, 53*b*, 55*a*, 55*b*, 57*a*, or 57*b* having the click groove 153 can be promoted and operation feeling of the switch knob 25, 27, or 29 can be promoted.

By forming the containing space 117 by attachably and detachably attaching the slider cover 59, 61, or 63 to the containing wall portion 37, 39, or 41 surrounding the fixed contact 83*a*, 83*b*, 89*a*, 89*b*, 95*a*, or 95*b*, the slider 47, 49, or 51 and the movable piece 53*a*, 53*b*, 55*a*, 55*b*, 57*a*, or 57*b* are contained and therefore, invasion of dust and dirt into the containing space 117 can be restrained and contact and detachment of the fixed contacts 83*a*, 83*b*, 89*a*, 89*b*, 95*a*, and 95*b* and the movable contacts 141, and the fixed contact portions 85*a*, 85*b*, 91*a*, 91*b*, 99*a*, and 99*b* and the movable contact portions 143 can be carried out further firmly.

The fixed contacts 83*a*, 83*b*, 89*a*, 89*b*, 95*a*, and 95*b*, the fixed contact portions 85*a*, 85*b*, 91*a*, 91*b*, 99*a*, and 99*b*, the movable contacts 141, the movable contact portion 143, the sliders 47, 49, and 51, the slider covers 59, 61, and 63 and the containing wall portions 37, 39, and 41 constitute small-sized switches, the fixed contacts 83*a*, 83*b*, 89*a*, 89*b*, 95*a*, and 95*b*, and the fixed contact portion 85*a*, 85*b*, 91*a*, 91*b*, 99*a*, and 99*b* and the containing wall portion 37, 39, and 41 are formed at the housing 6 and therefore, a number of parts and a number of integrating steps can be reduced and cost can be reduced.

Further, although according to the above-described embodiment, the click portion 147 is integrally molded with the contact portion 145 by using a mold, there can be constituted a structure in which the click portion 147 is previously molded separately by resin and the click portion 147 is fixedly attached to the contact portion 145 by adhering. In this case, the click portion 147 can be previously molded by molding by using a mold or cutting a plate member of resin.

Although an explanation has been given of the pivoting type switch of the power window switch 1 according to the embodiment of the invention, according to the invention, the switch knob 27 may be constructed by a structure in which the operating portion 27*a* is pivoted centering on the projected portions 139 constituting a shaft, by projecting to prolong the operating portion 27*a*, the switch can also be used as a lever type switch or a seesaw type switch.

What is claimed is:

1. A switch comprising:

a fixed contact fixedly supported by a housing;

a movable piece pivotably supported by the housing and having a movable contact brought into contact with and separated from the fixed-contact; and a switch knob pivotably supported by the housing for operating to move an elastic contact member brought into elastic contact with the movable piece, wherein the movable contact is brought into contact with and separated from the fixed contact by pivoting the movable piece by moving the elastic contact member on the movable piece by operating to pivot the switch knob; and the movable piece is provided with a contact portion made of a conductive material and a click portion made of a resin having a click groove formed so as to have an inclined surface upon which the elastic contact member moves.

2. The switch according to claim 1, wherein the click portion of the movable piece is formed to be flat and comprise the click groove at an end edge thereof and the click portion of the movable piece is arranged to erect relative to the housing such that the elastic contact member is brought into elastic contact with the click groove;

the elastic contact member is formed by a steel ball;

the elastic contact member is formed by a steel ball;

a ball support portion is provided in a cylindrical shape for containing the steel ball via an urging member and having an opening at an end portion thereof; and the opening of the ball support portion is provided with an engaging groove loosely fitted to the end edge of the click portion of the movable piece.

3. The switch according to claim 1 or 2, wherein a section of the click groove is formed in a recessed shape in accordance with an outer face in a spherical shape of the steel ball.

4. A switch comprising:

a fixed contact fixedly supported by a housing;

a movable piece pivotably supported by the housing and having a movable contact brought into contact with and separated from the fixed-contact;

a switch knob pivotably supported by the housing for operating to move an elastic contact member brought into elastic contact with the movable piece;

a containing wall portion provided at the housing for surrounding the fixed contact;

a slider supporting the elastic contact member and moved by operating to pivot the switch knob; and a slider cover attached to the containing wall portion attachably and detachably, forming a containing space for containing the slider and the movable piece between the slider cover and the containing wall portion and covering the slider movably; wherein the movable contact is brought into contact with and separated from the fixed contact by pivoting the movable piece by moving the elastic contact member on the movable piece by operating to pivot the switch knob; and the movable piece is provided with a contact portion made of a conductive material and a click portion made of a resin having a click groove.

5. A switch comprising:

a fixed contact fixedly supported by a housing;

a movable piece pivotably supported by the housing and having a movable contact brought into contact with and separated from the fixed-contact;

a switch knob pivotably supported by the housing for operating to move an elastic contact member brought into elastic contact with the movable piece;

a containing wall portion provided at the housing for surrounding the fixed contact;

a slider supporting the elastic contact member and moved by operating to pivot the switch knob; and a slider cover attached to the containing wall portion attachably and detachably, forming a containing space for containing the slider and the movable piece between the slider cover and the containing wall portion and covering the slider movably; wherein the movable contact is brought into contact with and separated from the fixed contact by pivoting the movable piece by moving the elastic contact member on the movable piece by operating to pivot the switch knob;

the movable piece is provided with a contact portion made of a conductive material and a click portion made of a resin having a click groove;

the click portion of the movable piece is formed to be flat and comprise the click groove at an end edge thereof and the click portion of the movable piece is arranged to erect relative to the housing such that the elastic contact member is brought into elastic contact with the click groove;

the elastic contact member is formed by a steel ball;

a ball support portion is provided in a cylindrical shape for containing the steel ball via an urging member and having an opening at an end portion thereof; and the opening of the ball support portion is provided with an engaging groove loosely fitted to the end edge of the click portion of the movable piece.

6. A switch comprising:

a fixed contact fixedly supported by a housing;

a movable piece pivotably supported by the housing and having a movable contact brought into contact with and separated from the fixed-contact;

a switch knob pivotably supported by the housing for operating to move an elastic contact member brought into elastic contact with the movable piece;

a containing wall portion provided at the housing for surrounding the fixed contact;

a slider supporting the elastic contact member and moved by operating to pivot the switch knob; and a slider cover attached to the containing wall portion attachably and detachably, forming a containing space for containing the slider and the movable piece between the slider cover and the containing wall portion and covering the slider movably; wherein the movable contact is brought into contact with and separated from the fixed contact by pivoting the movable piece by moving the elastic contact member on the movable piece by operating to pivot the switch knob;

the movable piece is provided with a contact portion made of a conductive material and a click portion made of a resin having a click groove; and a section of the click groove is formed in a recessed shape in accordance with an outer face in a spherical shape of the steel ball.

7. A switch comprising:

a fixed contact fixedly supported by a housing;

a movable piece pivotably supported by the housing and having a movable contact brought into contact with and separated from the fixed-contact;

a switch knob pivotably supported by the housing for operating to move an elastic contact member brought into elastic contact with the movable piece;

a containing wall portion provided at the housing for surrounding the fixed contact;

a slider supporting the elastic contact member and moved by operating to pivot the switch knob; and a slider cover attached to the containing wall portion attachably and detachably, forming a containing space for containing the slider and the movable piece between the slider cover and the containing wall portion and covering the slider movably; wherein the movable contact is brought into contact with and separated from the fixed contact by pivoting the movable piece by moving the elastic contact member on the movable piece by operating to pivot the switch knob;

the movable piece is provided with a contact portion made of a conductive material and a click portion made of a resin having a click groove;

the click portion of the movable piece is formed to be flat and comprise the click groove at an end edge thereof and the click portion of the movable piece is arranged to erect relative to the housing such that the elastic contact member is brought into elastic contact with the click groove;

the elastic contact member is formed by a steel ball;

a ball support portion is provided in a cylindrical shape for containing the steel ball via an urging member and having an opening at an end portion thereof;

the opening of the ball support portion is provided with an engaging groove loosely fitted to the end edge of the click portion of the movable piece; and a section of the click groove is formed in a recessed shape in accordance with an outer face in a spherical shape of the steel ball.

* * * * *